US006715260B1

(12) United States Patent
DeMatteis

(10) Patent No.: US 6,715,260 B1
(45) Date of Patent: Apr. 6, 2004

(54) METHOD AND APPARATUS FOR BAG LOADING AND DISPENSING

(75) Inventor: Robert B. DeMatteis, Grass Valley, CA (US)

(73) Assignee: Bob DeMatteis Co., Grass Valley, CA (US)

( * ) Notice: Subject to any disclaimer, the term of this patent is extended or adjusted under 35 U.S.C. 154(b) by 0 days.

(21) Appl. No.: 09/879,414

(22) Filed: Jun. 11, 2001

Related U.S. Application Data

(60) Provisional application No. 60/210,933, filed on Jun. 12, 2000.

(51) Int. Cl.[7] ..... B65B 67/00

(52) U.S. Cl. ..... 53/390; 53/384.1; 53/572; 53/459; 248/99; 248/290.1

(58) Field of Search ..... 248/100, 99, 290.1; 53/384.1, 572, 390, 459; 225/106

(56) References Cited

U.S. PATENT DOCUMENTS 3,646,723 A * 3/1972 Meroney ..... 141/390
3,779,496 A * 12/1973 Welles ..... 248/99
4,241,561 A * 12/1980 Suominen ..... 53/384.1
4,305,558 A * 12/1981 Baker ..... 248/100
4,316,353 A * 2/1982 Suominen ..... 248/100
4,750,694 A * 6/1988 Bateman ..... 248/175
4,863,125 A * 9/1989 Bateman ..... 16/308
5,433,413 A * 7/1995 Adams ..... 248/205.3
5,458,301 A * 10/1995 Cournoyer ..... 248/100
5,464,098 A * 11/1995 Tseng et al. ..... 206/554
5,507,713 A * 4/1996 Glod et al. ..... 493/194
5,590,784 A * 1/1997 Daniels ..... 206/554
5,667,173 A * 9/1997 Wilfong et al. ..... 248/100
6,171,226 B1 * 1/2001 DeMatteis ..... 493/226

* cited by examiner

*Primary Examiner*—Rinaldi I. Rada
*Assistant Examiner*—Louis Tran
(74) *Attorney, Agent, or Firm*—William Michael Hynes; Townsend and Townsend and Crew LLP

(57) ABSTRACT

A method and apparatus for securing, loading and singularly dispensing bags in a bag bundle from a dispensing hook includes a bag bundle formed from a plurality of stacked bags. Each bag has apertures are defined in the front panel and the rear panel adjacent the open top, these apertures having an opening of a selected dimension normal to the vertical side walls with an upper edge. A dispensing hook is used having parallel sides separated by a width complimentary to the selected dimension of the apertures to provide a secure, snug fit when the bag bundle is placed on the dispensing hook at the registered apertures. The dispensing hook defining a bag holding surface complimentary to the upper edge of the apertures.

13 Claims, 6 Drawing Sheets

METHOD AND APPARATUS FOR BAG LOADING AND DISPENSING

CROSS-REFERENCES TO RELATED APPLICATIONS

This application claims priority from Provisional Patent Application No. 60/210,933, filed Jun. 12, 2000 by the named inventor herein entitled Method and Apparatus for Bag Loading and Dispensing, is likewise incorporated by reference as if fully set forth herein.

This application references U.S. Provisional Patent Application No. 60/089,582, filed Jun. 17, 1998 by the named inventor herein entitled Plastic Bag Bundling System. patent application Ser. No. 09/258,010, filed Feb. 25, 1999 entitled Plastic Bag Bundling System is likewise incorporated by reference as if fully set forth herein.

This application references U.S. Provisional Patent Application No. 60/089,583, filed Jun. 17, 1998 by the named inventor herein and Don Pansier of Green Bay, Wis. entitled Automatic Ventilating System. U.S. patent application Ser. No. 09/258,033, filed Feb. 25, 1999 entitled Automatic Ventilating System is likewise incorporated by reference as if fully set forth herein.

This application references U.S. Provisional Patent Application No. 60/092,232, filed Jun. 9, 1998 by the named inventor herein entitled Plastic Bag Manufacturing Process. U.S. patent application Ser. No. 09/257,843, filed Feb. 25, 1999 entitled Automatic Ventilating System is likewise incorporated by reference as if fully set forth herein.

The above Patent Applications—and all of them—are herein incorporated by reference as if fully set forth herein with the subject matter of the present invention being independently patentable over all.

This invention relates to plastic bags and a method of improving their loading and dispensing ability. More specifically, this invention relates to plastic bags that are securely suspended on a compact suspension hook and then efficaciously loaded and dispensed.

BACKGROUND OF THE INVENTION

Presently, stand-up paper bags are used to carry many forms of customer purchases, such as foods sold in fast food restaurants, prescriptions in pharmacies, cookies in bakeries, order fulfillment in distribution warehouses and so on. One of the chief reasons paper bags are commonly used in these applications is due to their ability to stand up and be loaded with product. Most fast food restaurants and many other retailers use paper bags because the ability to stand up aids in loading and when loaded, helps keep the food from spilling out.

When using paper bags in high volume fast food restaurants, they are typically stored flat on a shelf. The user extracts a bag from the shelf, inserts a hand to open the bag and to "find the bottom", and then stands it up on a counter top. This generally takes about 3–5 seconds to prepare for loading. The term "find the bottom" typically refers to the need of a user to prepare the bottom of a bag—paper or otherwise—so that it can be stood up and loaded—or in some cases, properly loaded so it can stand up afterward.

Standard side-gusseted plastic bags, referred to as "pinch bottom bags", are dispensed from boxes or tear-away hooks. Examples include my Dual-Tab bags of U.S. Pat. No. 4,759,639 or those of U.S. Pat. No. 5,335,788, Wilfong, et al. These bags are generally unacceptable for most fast food applications since it takes more time than paper to extract the bag, find the bottom, stand it up and prepare it for loading.

Common prior art plastic T-shirt bags (grocery sacks) and their suspension/dispensing systems are used in many supermarket and fast food applications and may allow a user to find the bottom and load the bag as it is maintained in an open disposition on a dispensing rack. This is accomplished by using racks with long suspension arms—8 to 10 inches—in which the T-shirt bag handles are threaded and suspended thereon. The racks also typically have flat bases assisting the user to find the bottom by blousing out the bag and its gussets either before or during the loading process. In fast food applications, these bags are usually used for larger orders of boxes and tubs. But using this type of T-shirt bag and system for smaller bag sizes and orders is impractical and not cost effective. In a high-volume fast food restaurant application, it is also impractical to have a suspension/dispensing rack for every bag size—this would mean four different sizes of racks for a typical restaurant using four sizes of bags. There is simply not enough space to accommodate a multitude of racks. A minimum of two racks per bag size would usually be required so employees are not standing around waiting for the employee in front of them to finish loading a bag on the rack. Thus, eight space consuming racks would be extremely difficult to accommodate in a typical restaurant using 4 bag sizes. These problems represent the chief reasons why paper bags are still being used in most fast food applications.

Unfortunately the cost of paper bags has been skyrocketing and the need for a dispensing system for loading small, economic, thin-gauged plastic bags, that enables the user to efficaciously find the bottom has become more important than ever before. The preferred system would not be a space consuming suspension rack like those used with T-shirt bags. A compact suspension means that maintains a bag in a secure disposition, enables a user to find the bottom quickly or preferably upon loading of the bag, be quickly dispensed, and allows thin-gauged plastic bags to stand up after dispensing, would be ideal. It would be more desirable if the bags on the system also self-opened when dispensed.

The desirable traits of plastic over paper in many applications are also commonly known. They include superior strength, are more cost effective, improve food preservation qualities, take up less space in warehousing, have lower shipping costs, keep grease from leaking out and so on.

BRIEF SUMMARY OF THE INVENTION

A method and apparatus for securing, loading and singularly dispensing bags in a bag bundle from a dispensing hook includes a bag bundle formed from a plurality of stacked bags. Each bag has at least a front panel, a rear panel, and preferably has two vertical sides, a closed bottom and connection between the at least front panel and the rear panel to define an open top for the bag. Apertures are defined in the front panel and the rear panel adjacent the open top, these apertures having an opening of a selected dimension normal to the vertical side walls with an upper edge. The bag bundle has the respective apertures registered one to another. A dispensing hook is used having parallel sides separated by a width complimentary to the selected dimension of the apertures to provide a secure, snug fit when the bag bundle is placed on the dispensing hook at the registered apertures. The dispensing hook defining a bag holding surface complimentary to the upper edge of the apertures. When the bag bundle is place at the registered apertures on the hook, a rear wall for mounting of the hook and a front retaining edge extending above the bag holding surface confines and secures the bag bundle to the hook. The front retaining edge rises above the bag holding surface to enable bags on a forward-most panel of a forward-most bag to be pulled up and over and free of the front retaining edge. Thus, the forward-most bag may be loaded while securely retained on the hook and, subsequently singularly dispensed by pulling the bag from the hook. Dispensing occurs by pulling a forward-most bag at at least one panel off the bag holding surface over and beyond the front retaining edge. Such pulling enables the aperture of the panel to climb from the bag holding surface, up the front retaining edge and over the top, free of the bag holding surface and retaining edge of the hook.

The present invention relates to thin-gauged plastic bags that are suspended and loaded on, and dispensed from, a compact suspension hook (CSH). Various styles of bags may be used and include sideweld or bottom seal bag varieties. A system using a compact suspension hook enables support of a loaded or unloaded bag, enables the user to quickly find the bag bottom for loading, or upon being loaded, allows for efficacious, singular dispensing of the loaded thin-gauged bag so that it may stand up later.

The advantages of the present invention are substantial since bags loaded on, and dispensed from a CSH completely eliminate space-consuming, cumbersome grocery sack style racks and greatly improve the ease and speed of singularly dispensing a loaded bag. Using the present invention also results in high productivity than when using paper bags. Furthermore the apertures or die-cut handles cut into the bag and suspended on the CSH are generally far stronger than the weight of the contents of a loaded bag. Thus the system of the present invention may eliminate the need for suspension arms or racks with supporting bases.

Bags and their related systems such as those of U.S. Pat. No. 5,335,788, the Dual-tab bags of U.S. Pat. No. 4,759,639, or other types of common header bags will not support loaded contents. The weight of the loaded bag will cause the bag to tear free at the perforations connecting to the tabs or headers, or the separation apertures. These bag systems must have suspension arms or supporting bases, or both, to be serviceable as a loading device.

DETAILED DESCRIPTION OF THE INVENTION

Figure 1:
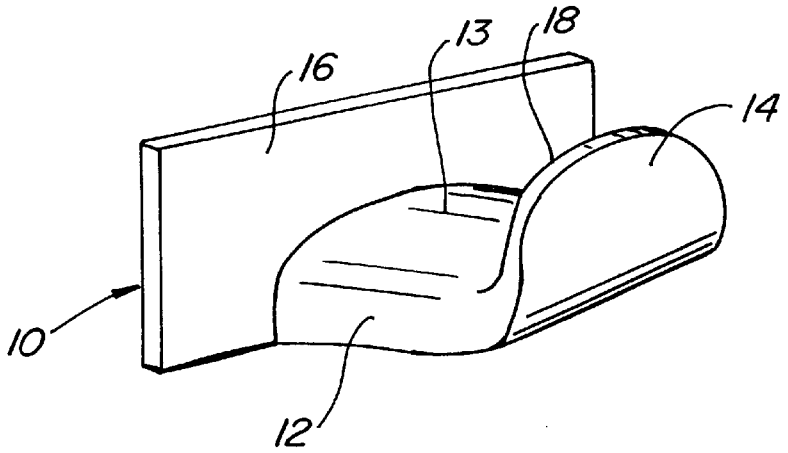
FIG. 1 is a perspective view of the basic compact suspension hook.

In FIG. 1 compact suspension hook 10 has a base 12, a front piece 14 and a back surface 16. The front piece 14 generally extends upward above base 12, about ½ to ¾ inches for use with a typical die-cut handle aperture with a 2 inch wide dimension, in order to form a retaining edge 18 so bags will not slip off and will be securely retained on the compact suspension hook. Base 12 is usually about 1½ to 2 inches long so that it may conveniently hold from 200 to 300 bags. Front piece 14 is typically about 3⁄32 inch thick; sufficient to ensure it will not break easily. compact suspension hook 10 may be mounted on the side of a counter or any generally vertical surface near bag loading areas, including bulkheads, or on a portable, stand-up style rack and so on. The compact suspension hook may be affixed by applying a small amount of super glue to back surface 16 or screwing in fasteners through holes (not shown) drilled through the back surface 16. Typically this type of hook would be made of an injection molded plastic, such as ABS or low-density polyethylene. The height of the retaining edge 18 is important as it must be short enough to allow a bag wall to climb it when subjected to a forward pulling force, and be subsequently free of the compact suspension hook as will be illustrated in the following figures. But it must also be tall enough so that bags will be securely retained before and during the bag loading process.

Figure 2:
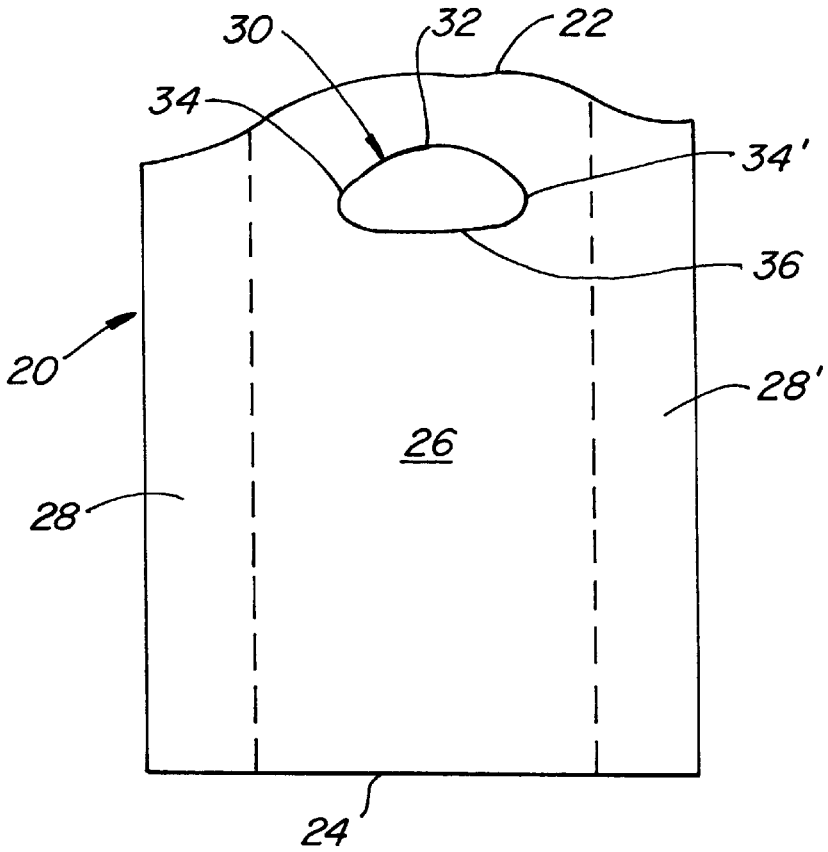
FIG. 2 is a plan view of a cooperating bag to be used on the compact suspension hook in FIG. 1.
Figure 3:
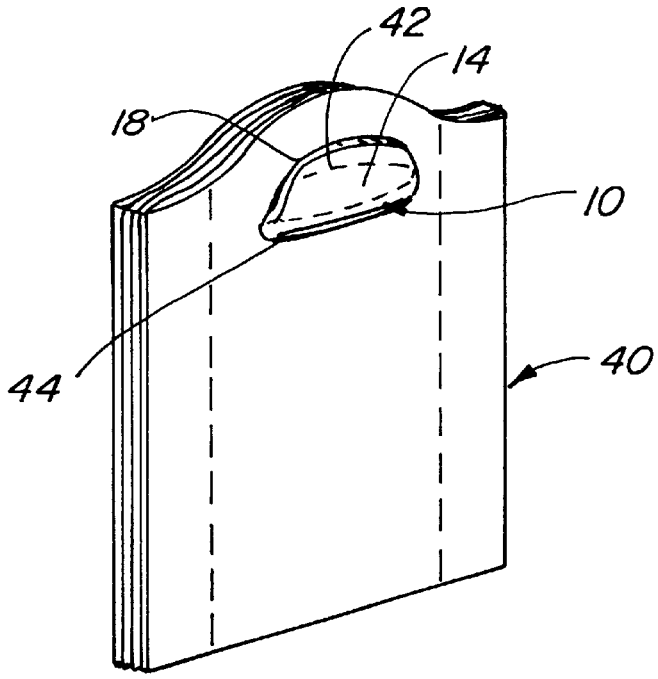
FIG. 3 is a perspective view of the compact suspension hook in FIG. 1 with a pack of bags such as those in FIG. 2 mounted onto it.
Figure 4:
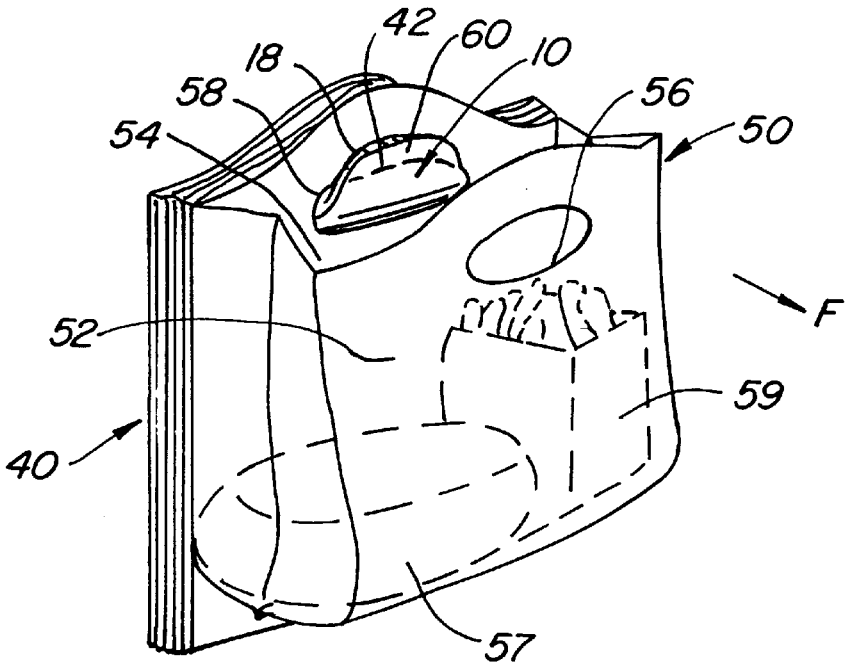
FIG. 4 is a perspective view of the forward-most bag of the bag pack in FIG. 3 loaded with food while suspended on the compact suspension hook of FIG. 1.
Figure 5:
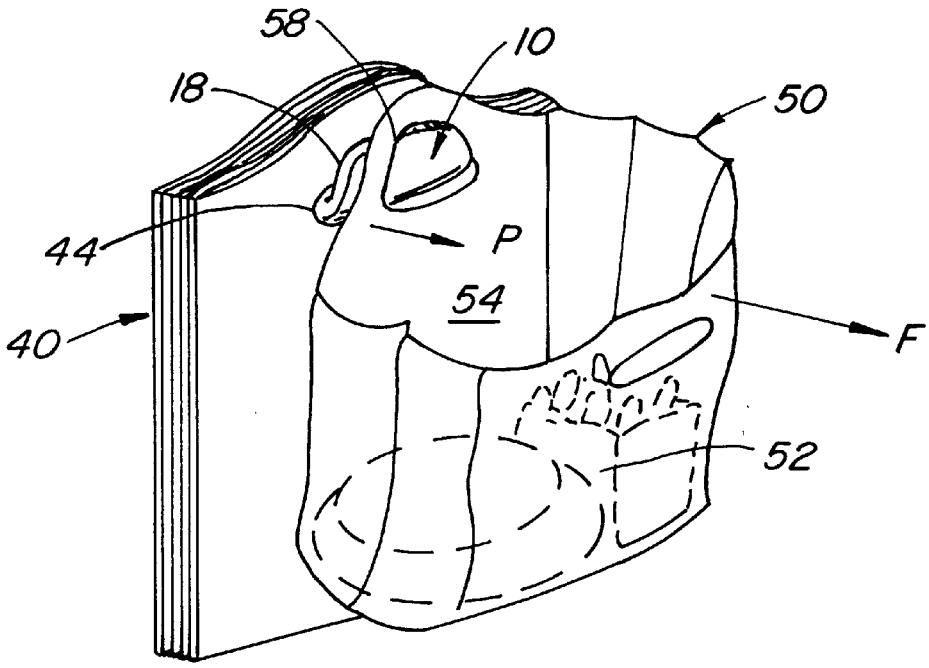
FIG. 5 is a perspective view of the forward-most bag of FIG. 4 being dispensed from its compact suspension hook.

In FIG. 2 bag 20 has an openable top 22, a sealed bottom 24, a body 26, side gussets 28 and 28', and a handle aperture 30. Handle aperture 30 has a top edge 32, two side edges 34 and 34' and a bottom 36. The overall circumference of the handle aperture is somewhat larger than the overall circumference dimensions of the front piece of the compact suspension hook in FIG. 1. This may be as little as 3%–15% or more. This will allow for the efficacious mounting of multiple bags onto a cooperating compact suspension hook as illustrated in FIG. 3, subsequent removal of the front bag wall from behind the retaining edge, thus opening the bag, then loading of the bag as illustrated in FIG. 4, and finally dispensing of the bag as illustrated in FIG. 5, which allows the rear bag wall to climb the retaining edge 18. The importance of the dimensions of the handle aperture in relation to the front piece and retaining edge of the compact suspension hook as well as its base, is that there must be a certain amount of "tightness" or friction resistance between the two, thus assisting in the retention of the bag on the compact suspension hook. There are other ways of accomplishing the tightness or friction resistance effect without making the circumference of the bag aperture slightly greater than the front piece or base. For instance, the overall width of the front piece may be slightly wider than the overall width of the handle aperture, thus creating friction resistance at the side edges upon dispensing. In such an example, the overall circumference of the front piece of the compact suspension hook may be substantially less than that of the handle aperture.

In FIG. 3 a pack of bags 40, comprised of bags such as those in FIG. 2, has been mounted onto compact suspension hook 10, by mounting aligned handle apertures 44 over the front piece 14 and behind the retaining edge 18, so that the upper edges 42 (shown in a dotted line) of aligned handle apertures 44 rest onto the base top 13 of base 12 (shown in FIG. 1). In this resting position, due to the tightness of the handle apertures mounted over and behind the cooperating front piece, the bags will not slip off easily if accidentally jarred by an employee. Also note that the base 12 of compact suspension hook 10 is preferably small enough to allow the bags to slide forward, but at the same time it would have some tightness to keep a bag, or bags, from accidentally sliding too far forward, thus climbing retaining edge 18 and falling off the compact suspension hook when jarred. This tightness may be easily accomplished by the methods described in FIG. 2.

In FIG. 4 forward-most bag 50 of bag pack 40 has had its front wall 52 pulled forward so that the forward-force F has caused front wall handle aperture 56 to climb up and over retaining edge 18 of hook 10. Rear wall 54 remains securely behind retaining edge 18 allowing bag 50 to be in an open disposition. This is due to the tightness factor as previously described. In other words, forward-force F has been exerted on the front wall 52 of forward-most bag 50 causing front wall aperture 56 to climb retaining edge 18 and be free of compact suspension hook 10. But due to the tightness of rear wall handle aperture 58 mounted on compact suspension hook base 12 (shown in FIG. 1), and combined with the abutment of rear wall portion 60 (represented as the bag wall portion above the dotted line) against retaining edge 18, rear wall 54 stays behind retaining edge 18 until such time as a sufficient forward pulling force is also applied to it. In this open disposition, the user may load the bag with product, such as a sandwich 57 and a french fry 59. Depending upon the nature of the product being loaded, a single handle aperture may be able to sustain a loaded weight as great 10 to 15 pounds or more. What is more interesting about loading bags on a compact suspension hook using handle apertures as the bag's suspension/loading means, is that it becomes easier to find the bag bottom, hence easier to load product so that the bag will stand up after it has been dispensed from the compact suspension hook. This is best accomplished when the back vertical surface in which the compact suspension hook has been mounted, extends below the compact suspension hook maintaining the back of the mounted bag packs vertically against the flat surface. Furthermore, this square-ing out effect is greatly enhanced by using any number of flat bottom plastic bag varieties available in the marketplace today.

In FIG. 5 the front bag wall 52 of forward-most bag 50 of bag pack 40 has been pulled forward by pulling force F, which applies a forward pulling force P to rear wall 54 and causes rear wall handle aperture 58 to climb retaining edge 18 and subsequently be free of compact suspension hook 10. Thus bag 50 may be presented to the customer or stood up on a counter top for further loading of product. Upon effecting the dispensing, which causes bag 50 to separate from the remainder of the bags on compact suspension hook 10, it is noted that the subsequent bags in bag pack 40 are securely maintained on compact suspension hook 10 due to the tightness between the aligned apertures 44 and compact suspension hook base 12 (as shown in FIG. 1) as well as abutting retaining edge 18 (as described in FIG. 4). There is another benefit to this cooperative relationship between the tightness of handle aperture and a base, front piece and retaining edge. When plastic bags are manufactured, they are typically made in unitary packs, which packs are bound together by stacking pins or cold seals. When forward-most bags in unitary packs are dispensed from a handle hook that is not of the present invention, the next bag or bags in sequence will typically tend to stick to the forward-most bag causing a double dispensing. However, this double dispensing is thwarted in the present invention as described herein due to the cooperative tightness of the handle aperture of the next bag in sequence to the compact suspension hook base, front piece and retaining edge.

Figure 6:
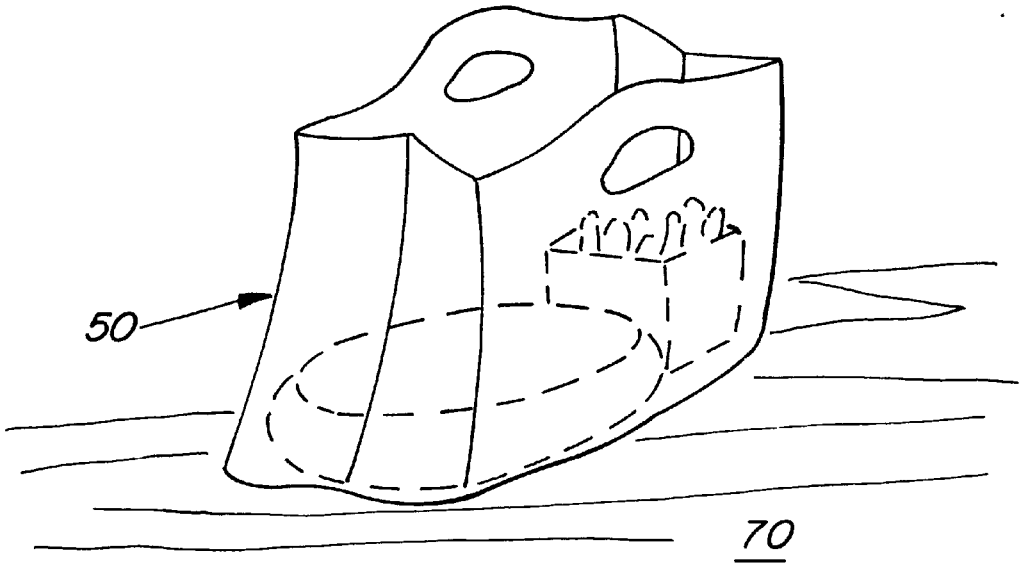
FIG. 6 is a perspective view of the forward-most bag of FIG. 4 loaded, completely free from the compact suspension hook, and standing up on a counter top, ready for additional condiments or napkins to be loaded or to be presented to a customer.

In FIG. 6 forward-most loaded bag 50 has been pulled completely free of compact suspension hook 10 by the user, who has placed it on counter top 70 in a stand-up disposition. It is now ready for additional condiments or napkins to be loaded or to be presented to the customer. It is due to the ability of loading a bag on a compact suspension hook in the previously described sequence that enables the loaded bag—a thin gauged plastic bag—to stand up reasonably well afterward.

Figure 7:
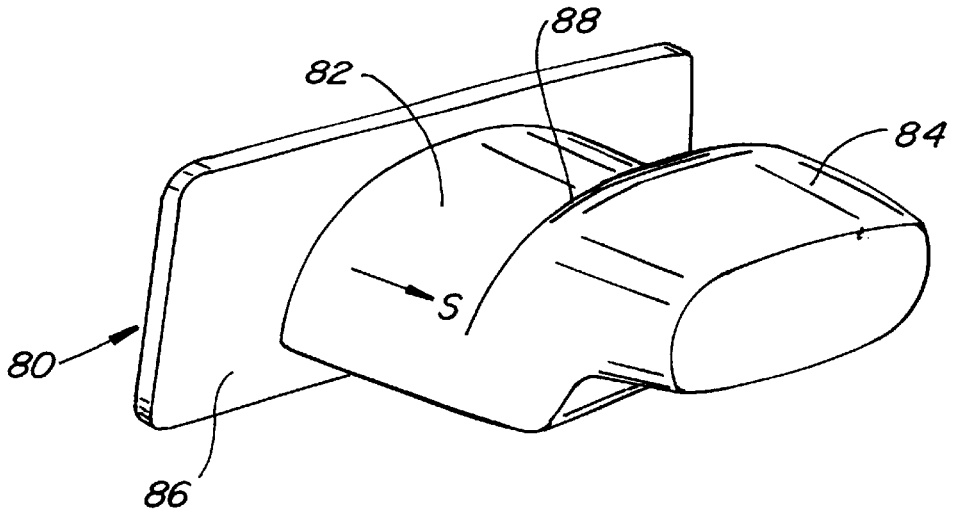
FIG. 7 is a perspective view of the preferred version of a compact suspension hook.

In FIG. 7 the preferred compact suspension hook 80 has a base 82, a nose 84 and a back surface 86. The nose 84 generally extends upward, about ½ to ¾ inches above base 82, for use with a typical die-cut handle aperture, in order to form a retaining edge 88 so bags will be securely retained on base 82. Base 82 is usually about 1½ to 2 inches long so that it may conveniently hold from 200 to 300 plastic bags. Nose 84 typically protrudes outward about 1 inch. compact suspension hook 10 may be mounted on the side of a counter or any vertical surface at the order processing, bag loading areas. The compact suspension hook may be affixed by applying a small amount of super glue to back surface 86 or screwing in fasteners through holes (not shown) drilled through the back surface 86. Typically, the preferred embodiment would be made of an injection molded plastic, such as ABS or low-density polyethylene. The retaining edge 88 serves the same purpose as the compact suspension hook of FIG. 1 by being short enough to allow a bag wall to climb it and be subsequently free of the compact suspension hook. The nose also serves the purpose of maintaining the front bag wall of the forward-most bag in the open position to allow a user to quickly insert a hand to begin the bag loading process. This is particularly important with high-volume, self-opening bags and their related systems. When a bag is dispensed from a compact suspension hook, frequently the next bag in sequence will close—or collapse—back upon itself, thus clinging to the front piece, such as in the compact suspension hook of FIG. 1, and making it difficult for the user to locate the front bag wall edge for opening prior to loading. This may be due to the self-opening bond between the bags not being great enough to cause the bag mouth of the next bag in sequence to open wide. It may also be due to static electricity in the film or any number of deficiencies or inconsistencies related to self-opening bag systems. Having a nose that keeps the bag from collapsing back upon itself may improve productivity significantly. The dispensing of bags from a compact suspension hook may be further improved by having the base 82 tilt slightly downward as illustrated by downward direction S at a 10-degree to 15-degree angle thus allowing bags to slip down the base more easily, and consistently causing the next-bag-in-sequence to be abutted retaining edge 88. The tightness of a bag aperture in cooperation with base 82 is just enough to allow a minor degree of resistant friction between the elements, but loose enough to allow, or encourage the bag pack to slide forward and abut itself up to retaining edge 88. This helps ensure more consistent dispensing of self-opening bags.

Figure 8:
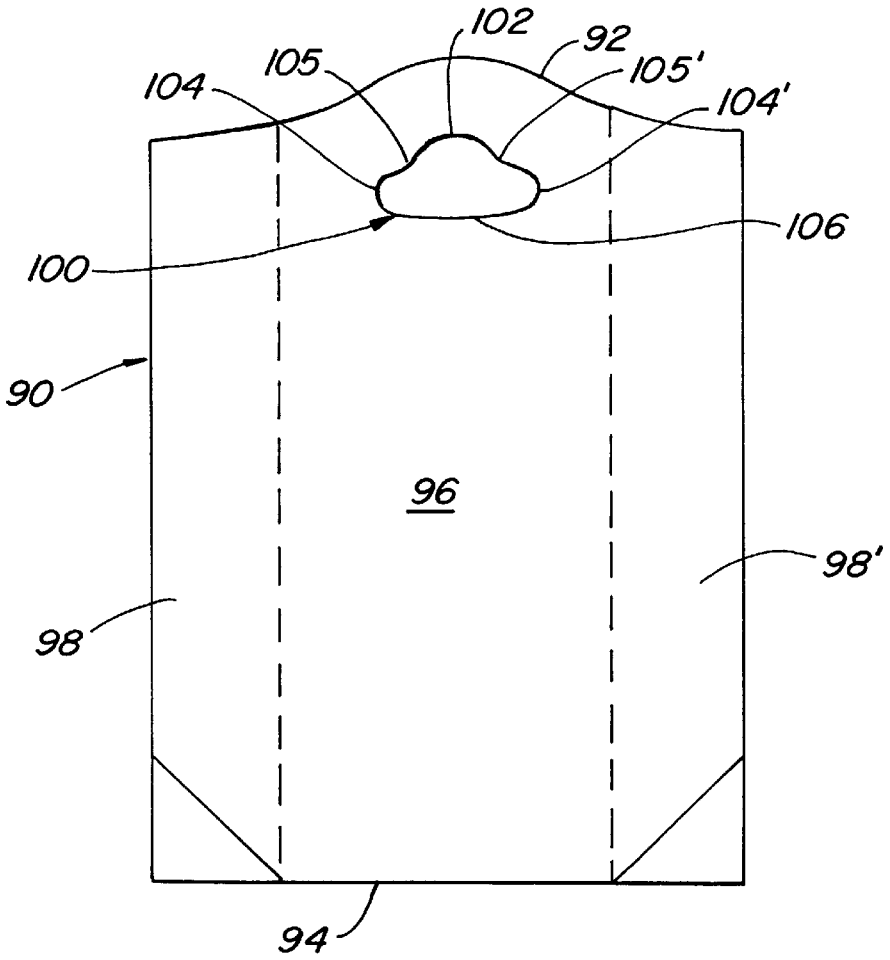
FIG. 8 is a plan view of the preferred version of a flat bottom bag to be used on the compact suspension hooks of FIGS. 1 or 7.

In FIG. 8 flat bottom bag 90 has an openable top 92, a sealed bottom 94, a body 96, side gussets 98 and 98', and a handle aperture 100. Handle aperture 100 has a top edge 102, two side edges 104 and 104', two flap elements 105 and 105' and a bottom 106. Similar to the handle aperture 30 in FIG. 2, the overall circumference of the handle aperture 100 is somewhat larger than the overall circumference dimensions of the base and front piece of the compact suspension hook in FIG. 1 or the base and nose in FIG. 7. Flap elements 105 and 105' improve the ease of dispensing bags from a compact suspension hook in that the flaps allow the handle apertures to climb a retaining edge more easily. Upon dispensing, the flaps 105 and 105' tend to fold under, forming a smoother, slide-able surface, thus giving a handle aperture less resistance from the abutment against a retaining edge and consequently allowing an aperture and bag wall to climb up and be free from the retaining edge. In addition, flat bottom bag 90 has a flat bottom created by its eight lineal, angular folding axes at the bottom outside portions of the side gussets and outer lower portions of the front and rear bag walls. This type of flat bottom bag is a common variety referred to in the industry as "having angular bottom seals". It may also incorporate newer technology of using angular hinges or cold seals as in my recent patent applications, or the flat bottom bag means may be that of any number of other technologies. What is important is having a bottom that may square out into a flat surface when loaded. The advantage of using flat bottom bags for dispensing on a compact suspension hook, is that the system allows the user to more efficaciously—more quickly—"find the bottom". Finding the bottom on square bottom bags when loading on a hook is an important first step. More time is consumed "trying to find the bottom" of a regular pinch bottom bag because the unfolding and/or folding up of the lower gussets portions do not necessarily cooperate with the squaring-out effect. This is because they do not have any predetermined, lineal folding axes. This first step by a user is important because it can save additional seconds in the bag loading process. For high volume users, the savings of just two to three seconds per bag, or per customer waiting in a drive-through line, significantly, positively impacts throughput and profit. It is also more desirable to have flat bottom bags assembled in unitary packs so that a user may mount a pack of 50 to 100 bags onto a compact suspension hook, instead of only a few at a time. It is even more desirable to have the pack of flat bottom bags dispensed from the compact suspension hook in a self-opening system, such as the many various types of bag packs available that use glues, cold seals, treated films and so on, or other mechanical or physical dispensing means. Self-opening in and of itself further improves throughput and contributes to added profit.

Figure 9:
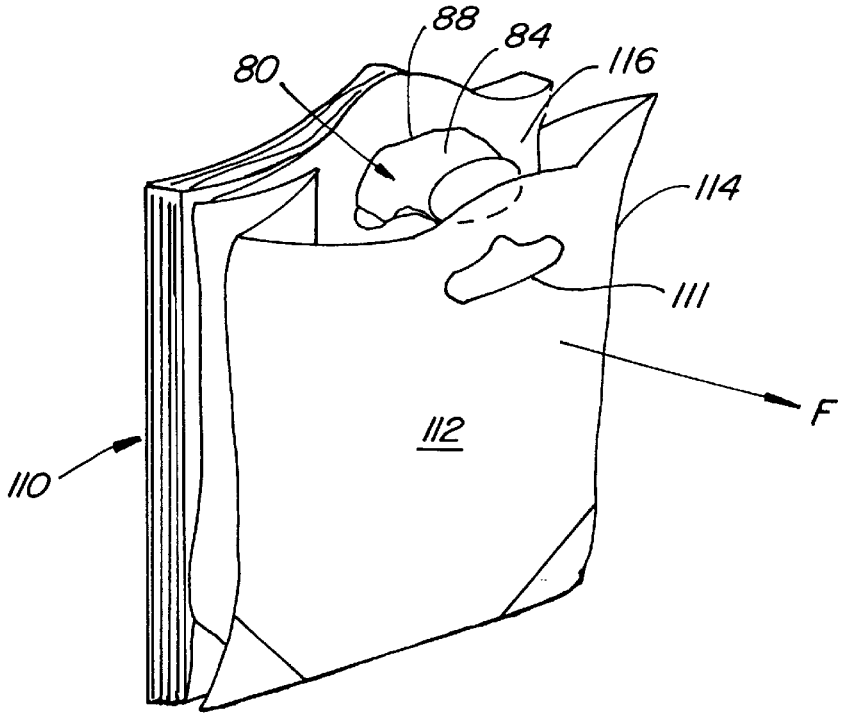
FIG. 9 is a perspective view of the compact suspension hook in FIG. 7 loaded with bags of the preferred version with the front wall of the forward-most bag open and detached from the compact suspension hook.

In FIG. 9, compact suspension hook 80 is loaded with a pack of square bottom bags 110, of the bag variety in FIG. 8. Due to force F, front wall aperture 111 has been completely detached from base 82 (shown in FIG. 7) and nose 84, by climbing retaining edge 88. This leaves the front wall 112 of the forward-most bag 114 openably separated from the rear wall 116 of forward-most bag 114 and bag pack 110, and is completely detached from the base 82 (FIG. 7), and nose 84 of compact suspension hook 80, thus maintaining an open disposition and ready for immediate loading by a user.

Figure 10:
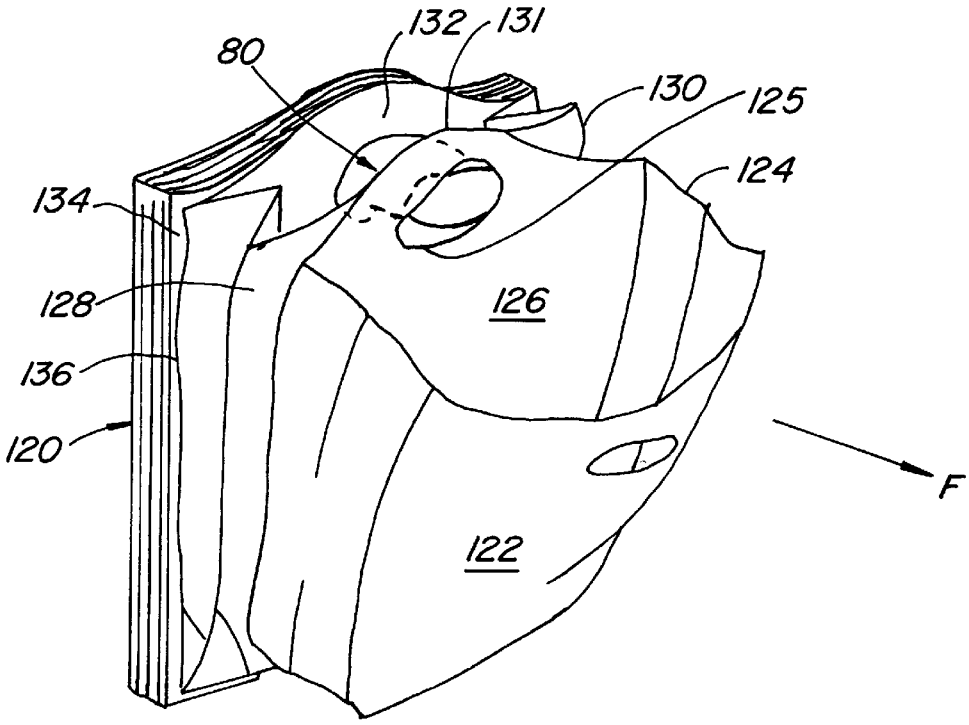
FIG. 10 is a perspective view of a self-opening forward-most bag such as that of FIG. 9 being dispensed from the compact suspension hook and self-opening the next bag in sequence.

In FIG. 10, compact suspension hook 80 is loaded with a pack of square bottom bags 120, of the a bag variety in FIGS. 8 and 9, which are of the self-opening bag pack variety. The front wall 122 of the loaded forward-most bag 124 is completely detached from compact suspension hook 80 and is being pulled forward by force F and the rear wall aperture 125 of forward-most bag 124 has also climbed over retaining edge 88 and detached rear wall 126 from compact suspension hook 80. Rear wall 126 being releasably bonded to the front wall 128 of next-bag-in-sequence 130 at top edge 131, has caused the front wall handle aperture (not shown) of front wall 128 to also climb retaining edge 88 and freeing front wall 128 from compact suspension hook 80. This phenomena is due to bond 131 between the rear wall 126 of forward-most bag 124 and the front wall 128 of next-bag-in-sequence 130 being greater than the resistance of the tightness, or friction of base 82 (FIG. 7) and retaining edge 88 and nose 84, and is also sufficient enough to cause the front wall handle aperture (not shown) of front wall 128 to climb up and over retaining edge 88, thus detaching front wall 128 from compact suspension hook 80. In concluding this self-opening action, the bond between the rear wall 126 of forward-most bag 124 and the front wall 128 of next-bag-in-sequence 130 is insufficient to overcome the combination of 1) the bond between the rear wall 132 of next-bag-in-sequence 130 to the front wall 134 of the yet following-bag-in-sequence 136 and back pack 120, along with; 2) the added tightness of the aligned apertures (not shown) of bag pack 120 at base 82 and nose 84 of compact suspension hook 80, and along with; 3) the added detention due to the following-bag-in-sequence 136 and bag pack 120 being abutted against retaining edge 88, thus causing bond 131 between rear wall 126 of forward-most bag 124 and the front wall 128 of next-bag-in-sequence 130 to separate and detach from one another (not shown). The result is that the forward-most bag will stand up when placed on a countertop and may now be presented to the customer, and the next-bag-in-sequence is left in an open disposition, ready for a subsequent loading, like the bag illustrated in FIG. 9. It is interesting to note that some users dispensing bags in this methodology will tend to develop a natural pattern of pulling the loaded bag straight forward, or slightly upward, and then after the front bag wall of the next-bag-in-sequence clears the compact suspension hook, they will tend to pull slightly downward. This slight downward motion tends to help make the rear wall of next-bag-in-sequence snag firmly on the retaining edge means 88 of the compact suspension hook, hence improving the speed and surety of singular dispensing, perhaps even speeding it up by a fraction of a second. The actual means of self-opening a bag, or a next-bag-in-sequence is not important. What is important is that in cooperation with a compact suspension hook and its elements, the bags being used may be sufficiently secured for loading on the hook, and/or may be maintained in an open disposition for quick access, and/or may be easily dispensed by a user, and/or may be allowed to self-open when dispensed in a one-at-a-time, self-opening manner.

Figure 11:
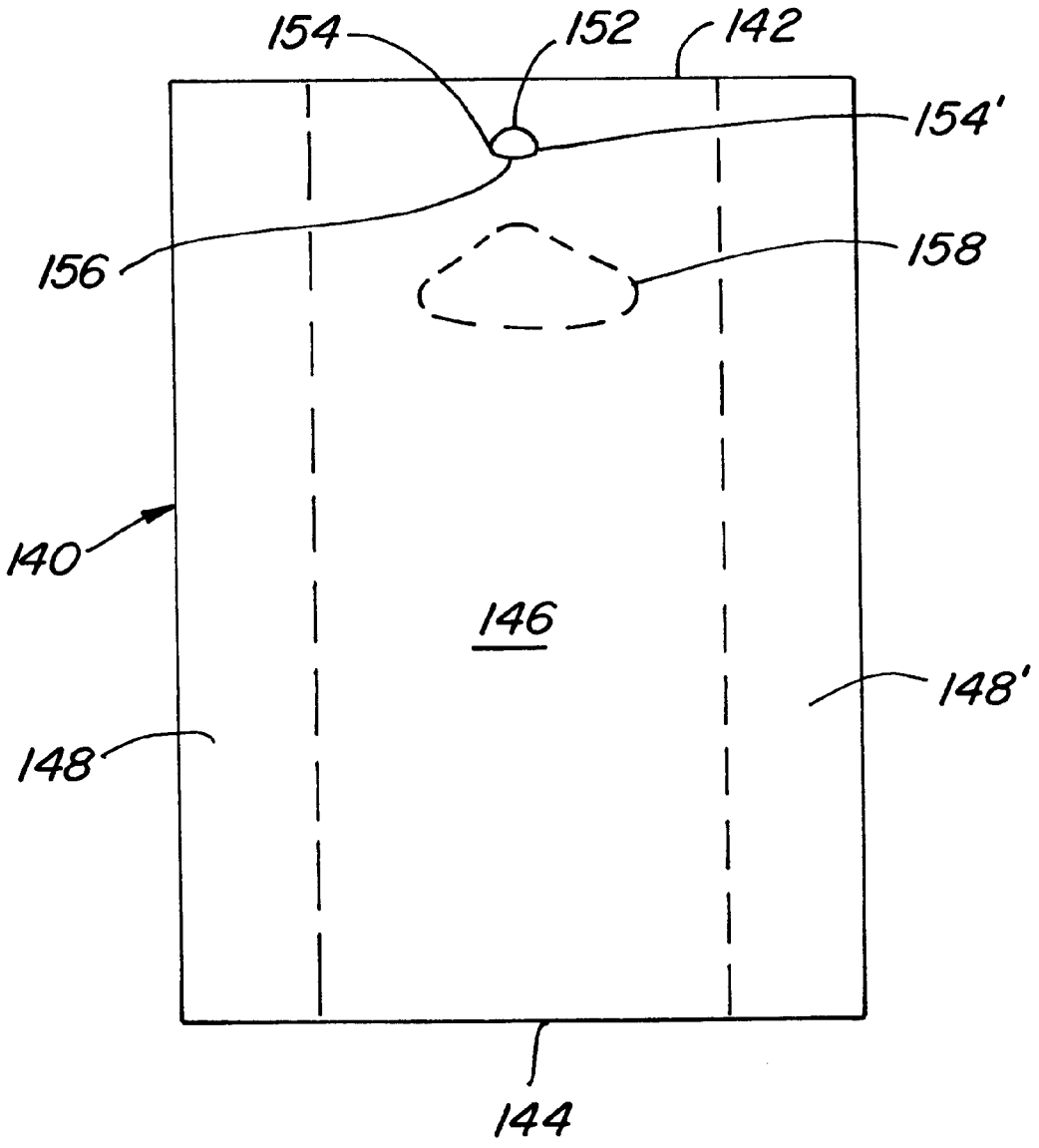
FIG. 11 is a plan view of a using a smaller dispensing aperture to be dispensed from a much smaller compact suspension hook with a bag that may not have handle apertures.

In FIG. 11 bag 140 has an openable top 142, a sealed bottom 144, a body 146, side gussets 148 and 148', and a small dispensing aperture 150, which does not serve as a handle aperture. Dispensing aperture 150 has a top edge 152, two side edges 154 and 154' and a bottom 156 and may resemble that of the handle aperture of the aforementioned bags, with the only variation being its smaller size, perhaps as small as ½ inch across from side edges 154 to 154' and as tall as ⅜ inch from top edge 152 to bottom edge 156. The smaller dispensing aperture 150 would typically be mounted onto a cooperating, yet much smaller, compact suspension hook similar in structure to those of FIGS. 1 and 7, which would serve as a "bag mounting peg" of a sort. All other facets would apply, for instance, the overall circumference of the dispensing aperture is somewhat larger than the overall circumference dimensions of the front piece, base or nose of its cooperating compact suspension hook. In utilizing and dispensing a bag of this variety it would be done in much the same manner as the previous bag examples, but would most likely have less suspension strength. Bags using dispensing apertures and compact suspension hooks may or may not have additional die cut handles illustrated by dotted lines 158. The bags may also be of the common T-shirt bag variety with the dispensing aperture centrally located between the two upwardly extending strap handles.

It should also be noted that the size and shape of the handle apertures or dispensing apertures and the cooperating compact suspension hook may vary. That is to say, that the handle or dispensing apertures may be perfectly round and the cooperating compact suspension hook a similar corresponding shape. Or, they may be in the shape of a race track or oval. The bag material may be plastic or may even be paper or some other plastic material. The principles described herein should accomplish the same objective. And once again, it is not important whether the bags are not self-opening or are self-opening, or are self-opened by an external means, what is important is that the compact suspension hook is used for secure loading of bag packs, quick, easy access to a bag being loaded, and efficacious dispensing when required.

What is claimed is:

1. Apertured bags in combination with a dispensing hook comprising:

a bag bundle formed from at least one bag, each bag including;

a bag having a front panel with two vertical sides, a rear panel with two vertical sides, a closed bottom and connection between the vertical sides of the front panel and the rear panel whereby the bag defines an open top;

handle apertures of identical size defined in the front panel and the rear panel adjacent the open top, the apertures having an opening of a selected dimension normal to the vertical side walls and panels with an upper edge to enable bag support at the upper edge by fingers of the hand;

the bag bundle having the respective apertures registered one to another;

a dispensing hook having parallel sides separated by a width complimentary to the selected dimension of the apertures, this complimentary width providing between the bags at the apertures and the hook a snug fit;

the dispensing hook defining a bag holding surface complimentary to the upper edge of the apertures whereby the bag bundle at the registered apertures can rest on the hook;

the bag holding surface having a rear wall for mounting of the hook and maintaining the bags on the hook;

a front retaining edge extending above the bag holding surface whereby a bundle of bags is confined on the hook between the rear wall and the front retaining edge;

a sloping surface between the front retaining edge and the bag holding surface for defining a continuous surface rising above the bag holding surface; and, the sloping surface rising above the bag holding surface to the front retain edge sufficient to enable a handle aperture to climb from the bag holding surface up the sloping surface and over the top of the front retaining edge upon pulling off a bag panel from the bag holding surface over and beyond the front retaining edge.

2. Apertured bags in combination with a dispensing hook according to claim 1 comprising:

the bag bundle includes a plurality of bags.

3. Apertured bags in combination with a dispensing hook according to claim 2 comprising:

the plurality of bags are of the same size.

4. Apertured bags in combination with a dispensing hook according to claim 3 comprising:

a surface for supporting the bottom of the bags; and, a support for the dispensing hook to support the bags above the surface to enable the bottom of the bag to rest on the surface.

5. Apertured bags in combination with a dispensing hook according to claim 2 comprising:

a severable attachment between a trailing panel of a leading bag and a leading panel of a trailing bag; and, the trailing panel of the leading bag has attachment to the leading panel of the trailing bag to enable an aperture to climb from the bag holding surface over the top of the front retaining edge to open the trailing bag when the leading bag is removed from the bag bundle.

6. Apertured bags in combination with a dispensing hook according to claim 2 comprising:

the dispensing hook includes a continuous seamless surface at the bag holding surface, the retaining edge, and surfaces between the bag holding surface and the retaining edge.

7. A method for dispensing apertured bags from a dispensing hook comprising the steps of:

providing a bag bundle formed from at least one bag, each bag including;

a bag having a front panel with two vertical sides, a rear panel with two vertical sides, a closed bottom and connection between the vertical sides of the front panel and the rear panel whereby the bag defines an open top;

handle apertures of identical size defined in the front panel and the rear panel adjacent the open top, the apertures having an opening of a selected dimension normal to the vertical side walls and panels with an upper edge to enable bag support at the upper edge by fingers of the hand;

the bag bundle having the respective apertures registered one to another;

providing a dispensing hook having parallel sides separated by a width complementary to the selected dimension of the apertures, this complementary width providing between the bags at the apertures and the hook a snug fit;

providing on the dispensing hook a bag holding surface complementary to the upper edge of the apertures whereby the bag bundle at the registered apertures can rest on the hook with the snug fit;

providing a rear wall for mounting of the hook and maintaining a placed bundle of bags at the apertures on the hook;

providing a front retaining edge extending above the bag holding surface;

providing a sloping surface between the front retaining edge and the bag holding surface for defining a continuous surface rising above the bag holding surface; the sloping surface rising above the bag holding surface to the front retaining edge sufficient to enable a handle aperture to climb from the bag holding surface up the sloping surface and over the top of the front retaining edge upon pulling off a bag panel from the bag holding surface over and beyond the front retaining edge;

placing a bundle of bags on the hook between the rear wall and the front retaining edge at the apertures to enable the parallel sides, the front retaining edge and the bag holding surface to hold with the snug fit each aperture of each bag panel;

maintaining bags on the hook at the apertures on the bag holding surface when a bag panel is not pulled;

pulling the front panel of a bag to pull the aperture of the front panel up the sloping surface and over the front retaining edge while the aperture of the rear panel remains at the front retaining edge to allow the bag to be held open between the front and rear panels for filling, and pulling the rear panel of a bag to pull the aperture of the rear panel from the bag holding surface up the sloping surface and over the top of the front retaining edge when the loaded bag is dispensed from the hook.

8. The method for dispensing apertured bags in a bag bundle from a dispensing hook according to claim 7 and including after the step of pulling the forward-most bag at its forward-most panel off from the bag holding surface over and beyond the front retaining edge and having its rear panel confined on the hook between the rear wall and the front retaining edge to open the bag:

loading the forward-most bag so that when a user loads contents into the bag a flat bottomed surface is formed.

9. The method for loading apertured bags in a bag bundle from a dispensing hook according to claim 8 and wherein the step of pulling the rear panel of a bag includes:

pulling the loaded bag away from the hook at its front panel whereby the bag at its rear-most panel moves at its aperture over the front retaining edge from the bag holding surface free and clear of the dispensing hook.

10. The method for loading apertured bags in a bag bundle from a dispensing hook according to claim 7 and including the step of:

providing a severable attachment of the trailing edge of a leading bag to the leading edge of a trailing bag to enable bags to be dispensed from the bag bundle in an open disposition.

11. The method for loading apertured bags in a bag bundle from a dispensing hook according to claim 7 and including the step of:

providing a continuous seamless surface on the dispensing hook between the bag holding surface, the retaining edge and the parallel sides.

12. A dispensing bag hook for use in combination with bags where the bags includes:

a bag bundle formed from at least one bag, each bag including;

a bag having a front panel with two vertical sides, a rear panel with two vertical sides, a closed bottom and connection between the vertical sides of the front panel and the rear panel whereby the bag defines an open top;

handle apertures of identical size defined in the front panel and the rear panel adjacent the open top, the apertures having an opening of a selected dimension normal to the vertical side walls and panels with an upper edge to enable bag support at the upper edge by fingers of the hand;

the bag bundle having the respective apertures registered one to another;

a dispensing apparatus to enable the bags to be singulated, the improvement to the dispensing apparatus comprising:

a dispensing hook having parallel sides separated by a width complementary to the selected dimension of the apertures, this complementary width providing between the bags at the apertures and the hook a snug fit;

the dispensing hook defining a bag holding surface complementary to the upper edge of the apertures whereby the bag bundle at the registered apertures can rest on the hook;

the bag holding surface having a rear wall for mounting of the hook and maintaining the bags on the hook;

a front retaining edge extending above the bag holding surface whereby a bundle of bags is confined on the hook between the rear wall and the front retaining edge;

a sloping surface between the front retaining edge and the bag holding surface for defining a continuous surface rising above the bag holding surface, the sloping surface rising above the bag holding surface to the front retaining edge sufficient to enable a handle aperture to climb from the bag holding surface up the sloping surface and over the top of the front retaining edge upon pulling off a bag panel from the bag holding surface over and beyond the front retaining edge;

the parallel sides, the front retaining edge, the sloping surface and the bag holding surface enabling an aperture to separately climb from the bag holding surface up over the top of the front retaining edge upon pulling off a bag panel from the bag holding surface over and beyond the front retaining edge whereby:

bags are maintained at the apertures on the bag holding surface without the pulling of a bag panel;

an aperture of the front panel of a bag can be pulled up the sloping surface and over the front retaining edge while the aperture of the rear panel remains at the front retaining edge to allow the bag to be held open for filling, and the aperture of the rear panel can climb from the bag holding surface up the sloping surface and over the top of the front retaining edge when the loaded bag is dispensed from the hook.

13. The dispensing bag hook for use in combination with bags according to claim 12 where the bags includes:

the front retaining edge extending to the side of the bag holding surface.

* * * * *